United States Patent [19]

Eichhorn

[11] Patent Number: 4,966,178

[45] Date of Patent: Oct. 30, 1990

[54] TENT MOVABLE BETWEEN A COLLAPSED POSITION AND A LATCHED ERECT POSITION

[75] Inventor: Anthony E. Eichhorn, East Amherst, N.Y.

[73] Assignee: The Quaker Oats Company, Chicago, Ill.

[21] Appl. No.: 407,363

[22] Filed: Sep. 14, 1989

[51] Int. Cl.[5] ..... E04H 15/40

[52] U.S. Cl. ..... 135/104; 135/98; 135/106; 403/64; 403/217

[58] Field of Search ..... 135/101, 102, 105, 106, 135/104, 98; 403/217, 218, 64

[56] References Cited

U.S. PATENT DOCUMENTS

| | | | |
|---|---|---|---|
| 2,953,145 | 9/1960 | Moss et al. | 135/98 |
| 3,181,542 | 5/1965 | Bareis | 403/64 X |
| 3,929,146 | 12/1975 | Maiken | 135/98 |
| 4,033,366 | 7/1977 | Forget | 135/98 |
| 4,193,413 | 3/1980 | Watts et al. | 135/98 |
| 4,566,245 | 1/1986 | Ruter | 403/218 X |
| 4,627,210 | 12/1986 | Beaulieu | 135/106 X |
| 4,637,748 | 1/1987 | Beavers | 403/217 X |
| 4,750,509 | 6/1988 | Kim | 135/105 X |

FOREIGN PATENT DOCUMENTS

| | | | |
|---|---|---|---|
| 0239422 | 9/1960 | Australia | 135/102 |
| 0453190 | 6/1913 | France | 135/102 |
| 0589458 | 3/1959 | Italy | 135/104 |
| 0159905 | 4/1933 | Switzerland | 135/102 |

*Primary Examiner*—Richard E. Chilcot, Jr.
*Assistant Examiner*—Lan Mai
*Attorney, Agent, or Firm*—Cumpston & Shaw

[57] ABSTRACT

A tent is disclosed having movable tent poles for supporting a flexible tent body. An apex junction member is provided for pivotally supporting one of the ends of each of the tent poles, the opposite ends of which are held in a fixed position. A tensioning member is provided movable between a normal position in which the tent is collapsed with the tent poles parallel and adjacent to each other, and a tensioned position for tensioning the tent poles in a splayed apart configuration for placing the tent body in an erect position. A latch member is provided for releasably latching the tensioning member in its tensioned position and the tent in its erect position.

7 Claims, 6 Drawing Sheets

TENT MOVABLE BETWEEN A COLLAPSED POSITION AND A LATCHED ERECT POSITION

BACKGROUND OF THE INVENTION

1. Field of the Invention:

This invention relates generally to tents, and more particularly to a tent having a latch means for releasably latching the tent in its erect position.

2. Description of the Prior Art:

One of the most enjoyable and relatively inexpensive recreational pursuits indulged in by families is camping or going to the beach. In addition to family camping, children generally love to indulge in organizational camp outings arranged, for example, by scout groups. When not indulging in the real thing, small children love to "act out" camping within the home. A consumer need exists, particularly for small tents, that can be erected quickly, and when the play or serious camping is over, conveniently collapsed for storage. Such tents are also useful to protect infants from the sun, insects and the like whit at the beach. Although the present invention finds particular applicability to small tents and cabanas, it is feasible that the invention could be incorporated in tents for adults.

SUMMARY OF THE INVENTION

An object of the present invention is to provide a tent that is movable between a collapsed position and a latched erect position comprising:

- a flexible tent body;
- tent poles for supporting the tent body;
- apex junction means for supporting one of the ends of the tent poles;
- means for releasably holding the opposite end of the tent poles in a fixed position;
- tensioning means movable between a normal tensioned position in which the tent is collapsed to a tensioned position for tensioning the tent poles for placing the tent in an erect position; and
- latch means movable between a normal unlatched position to a lateral position for latching the tensioning means in its tensioned position and the tent body in its erect position.

In a more specific object of the invention, the apex junction means comprises a base member having a plurality of slots, each adapted to receive a pivotally mounted adapter secured to one end of a tent pole. The tent body has a bottom panel, and the holding means comprises openings or pockets in the bottom panel for receiving the opposite ends of the tent poles. The tensioning means for the tent comprises a cap member slidably mounted on the base member, and adapted, when pressed downwardly, to engage the adapters and to bend and tension the tent poles. The latch means comprises a fixed latch lug on the base member, engageable by a latch ear on a slidable spring-biased latch bar on the cap member. The cap member is cup-shaped, and has a plate secured thereto, and the latch bar is slidably mounted between the cap member and plate with the latch ear extending through the plate. The latch ear and latch lug have slidably engaging cam surfaces terminating in a latch ear shoulder and a latch lug shoulder. When the cap member is pressed downwardly the latch ear is retracted by the cam surfaces, until the cam surfaces are moved out of engagement. When this occurs, the ear shoulder is spring-biased in front of the lug shoulder for latching the latch means in a lateral position. The end of the bar extends outwardly from the cap member, and forms a button. When the button is pressed, the latch ear is retracted from the latch lug to release the latch means.

BRIEF DESCRIPTION OF THE DRAWINGS

In the detailed description of the invention presented below, reference is made to the accompanying drawings, in which.

DETAILED DESCRIPTION OF THE INVENTION

Because tents and parts thereof are well-known, the present description will be directed in particular to elements forming part of, or cooperating directly with, tent apparatus in accordance with the present invention. It is to be understood that elements not specifically shown or described may take various forms well known to those in the art.

Figure 1:
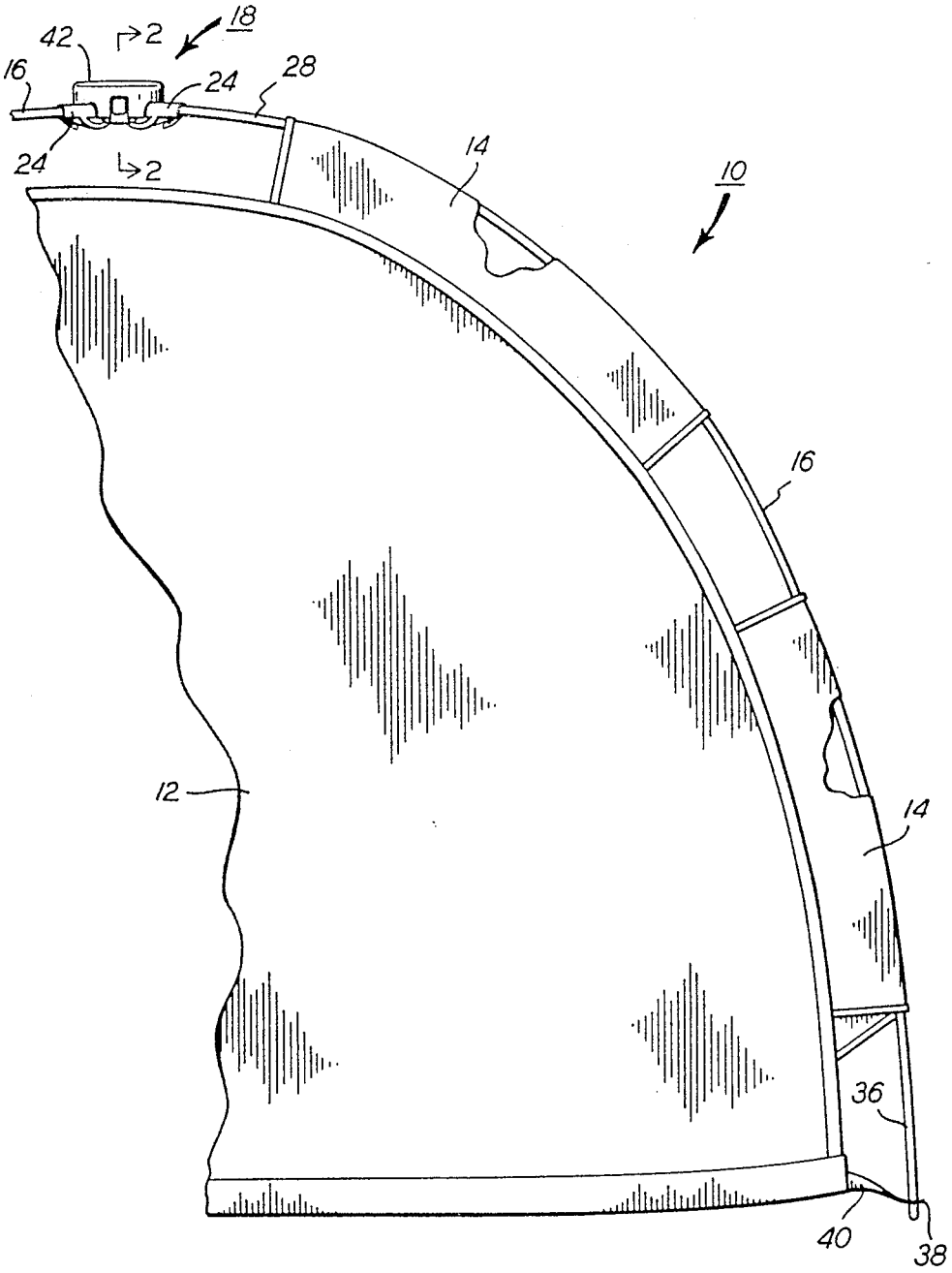
FIG. 1 is a segmental side-elevational view of a preferred embodiment of the tent of this invention in its erect condition.

With reference to FIG. 1, a preferred embodiment of a tent or cabana 10 of this invention is disclosed, comprising a dome-shaped tent body 12, only a part of which is shown, formed from any suitable fabric material, canvas or the like. The tent body 12 has angularly spaced elongated sleeves 14 extending outwardly from the body 12, for receiving flexible tent poles 16 of plastic or the like. The tent poles are part of a skeleton support means for supporting the tent body 12. The skeleton support means further comprises an apex junction means 18 at the tent apex for pivotally supporting one of the ends 28 of each of the four tent poles 16, only one of which poles is shown fully in FIG. 1.

With reference to FIGS. 2–7, the apex junction means 18 comprises a base member 20, having four slots 22 for receiving adapters 24 at the ends of the four tent poles 16. Each adapter 24 has a blind bore 26 at one end thereof for receiving one end 28 of a tent pole which is rigidly secured thereto by any suitable means. The opposite end of the adapter 24 is pivotally secured to the base member 24 by a pin 30, and further has an arcuate surface 32 terminating in a flat surface 34. The opposite ends 36 of the tent poles 16 are attached to the tent body by any suitable means, such as the pole end extending through an opening in a circular grommet 38 at the end of outwardly extending tent flaps 40, as best seen in FIG. 1. Another way of attaching the tent pole ends 36 to the tent body is to provide each flap with a pocket at the end thereof, into which the pole end is insertable.

A tensioning means is provided movable between a normal position in which the tent 10 is collapsed, to a tensioned position, and the poles are parallel and adjacent to each other, as seen in FIG. 1, for tensioning the tent poles 16 in a splayed configuration and placing the tent body 12 in an erect position. The tensioning means comprises a cup-shaped cap member 42 having a pair of depending posts 44, as most clearly appear in FIGS. 4, 6 and 7, that extend through openings 46 in a circular plate 48, and into openings 50 in the base member 20 within which the posts 44 are slidably movable. The cap member 42 is prevented from pulling out of the base member 20 by a screw 52 and washer 54 affixed to the ends of each of the posts 44. The plate 48 is secured to the cap member 42 by screws, not shown, threaded into bosses 56 depending from the cap member. The plate 48 further has a plurality of stamped-out protruberances to provide stop members 58 engageable by the flat surfaces 34 of the tent pole adapters 24. The stop members 58 limit pivotal movement of the untensioned tent poles 16 in a downward direction, when the cap member 42 is in a normal position, as seen in FIG. 2.

Figure 2:
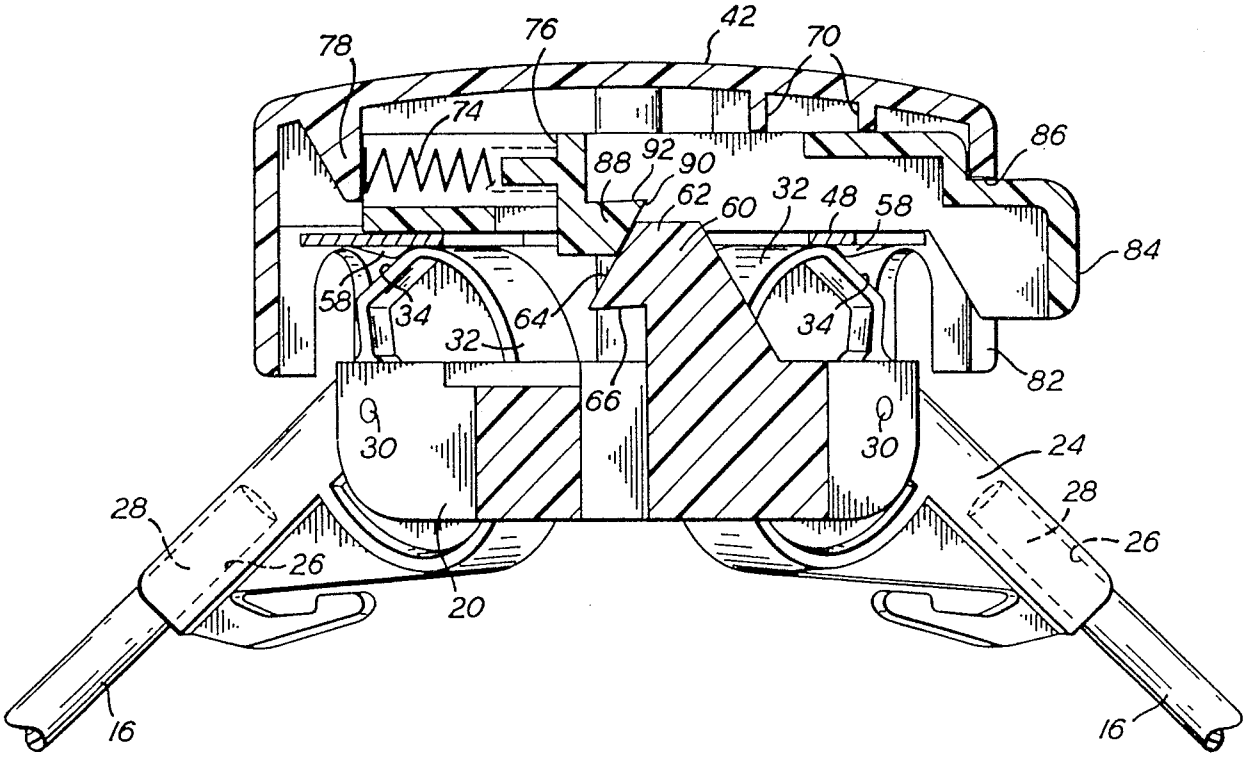
FIGS. 2 and 3 are enlarged section views of the apex junction means, tensioning means, and latch means of the tent taken substantially along line 2—2 of FIG. 1 showing the same in an unlatched configuration and in a latched configuration respectively.
Figure 3:
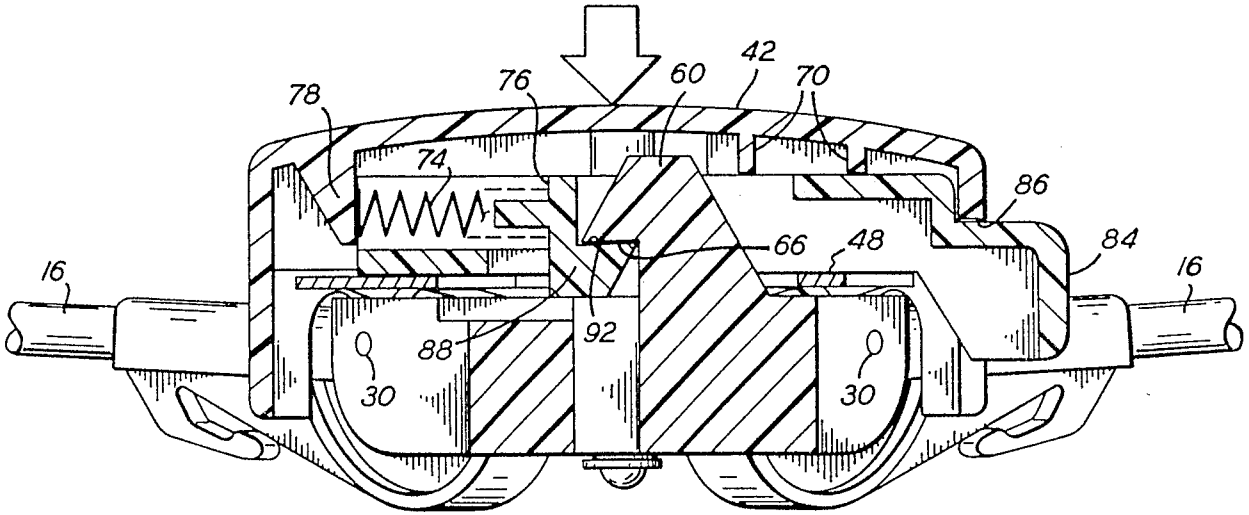
Figure 4:
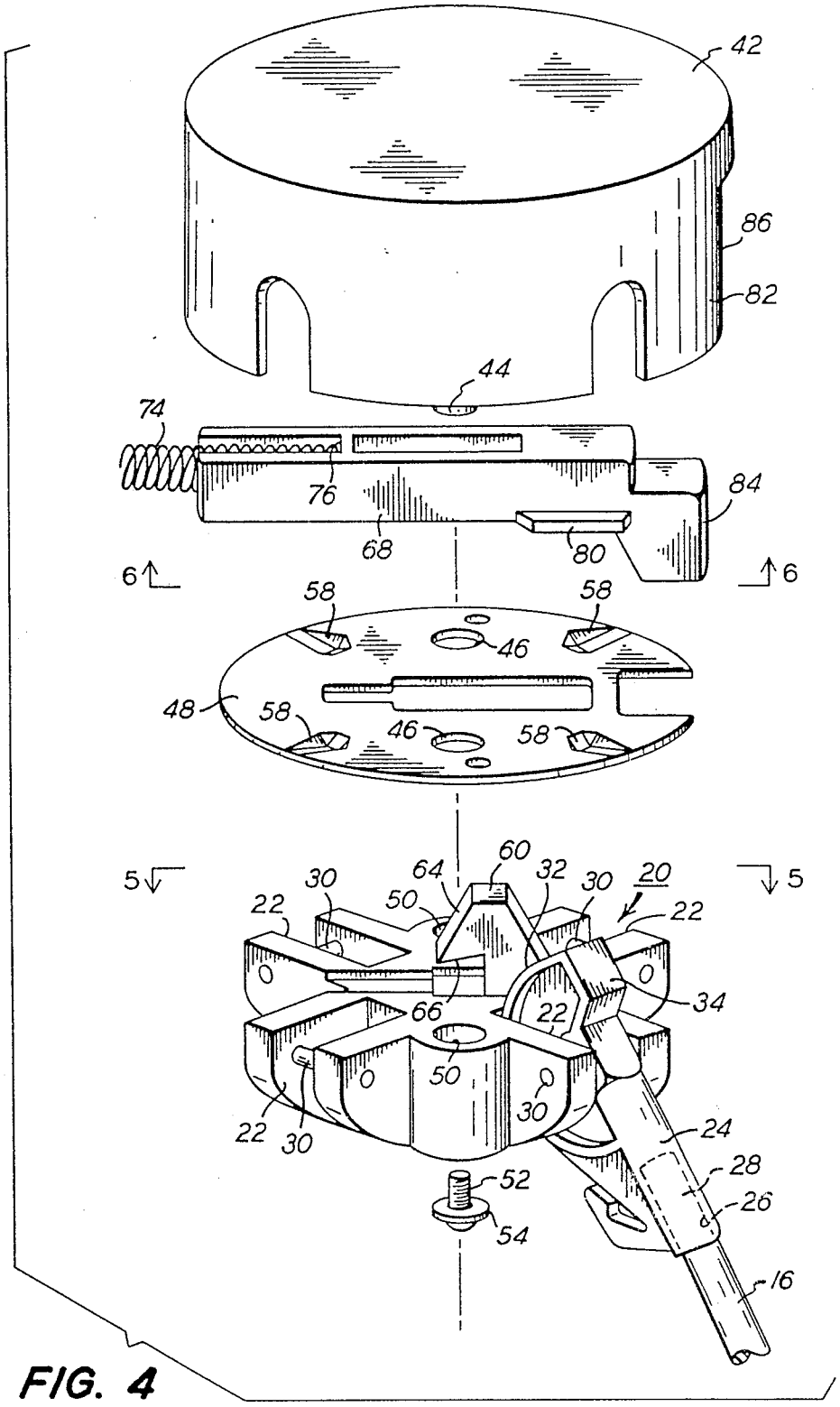
FIG. 4 is an exploded view in perspective of the apex junction means, tensioning means, and latch means of FIG. 2.
Figure 5:
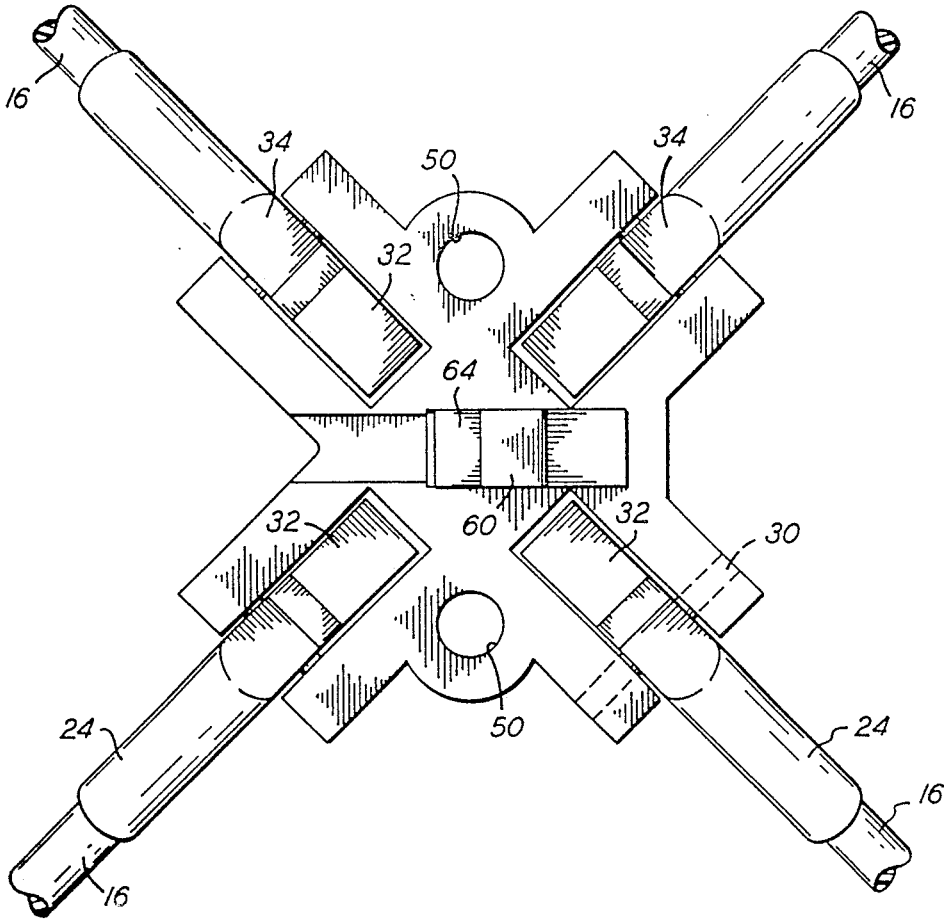
FIG. 5 is a top plan view of the apex junction means of this invention, taken substantially from line 5—5 of FIG. 4.
Figure 6:
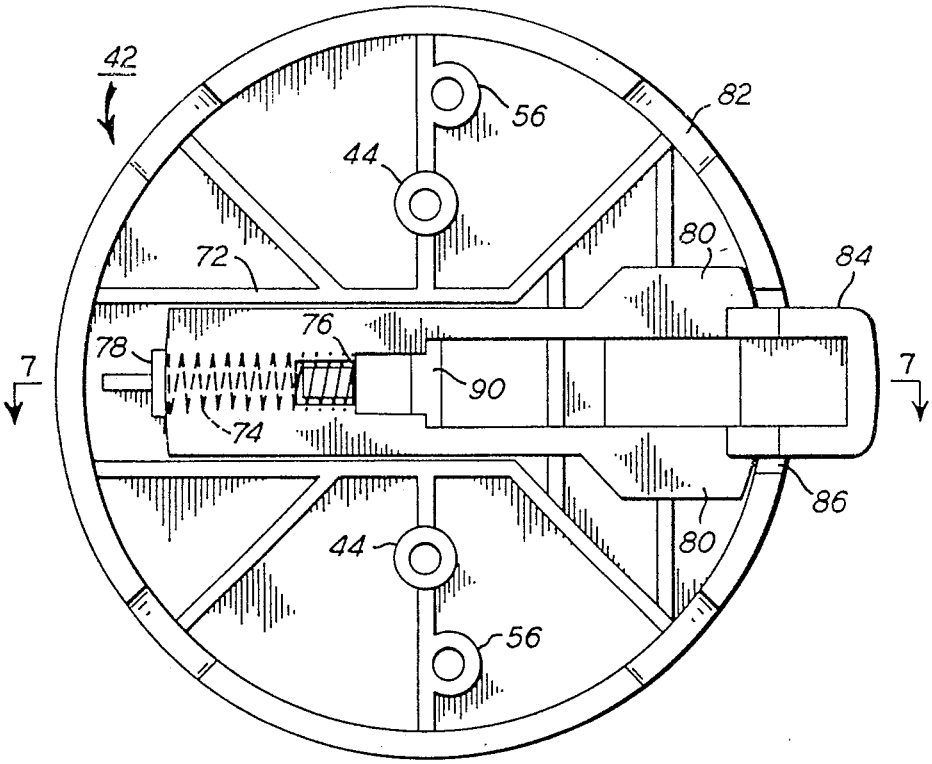
FIG. 6 is a bottom view of the assembled cap member and latch bar taken substantially from line 6—6 of FIG. 4.
Figure 7:
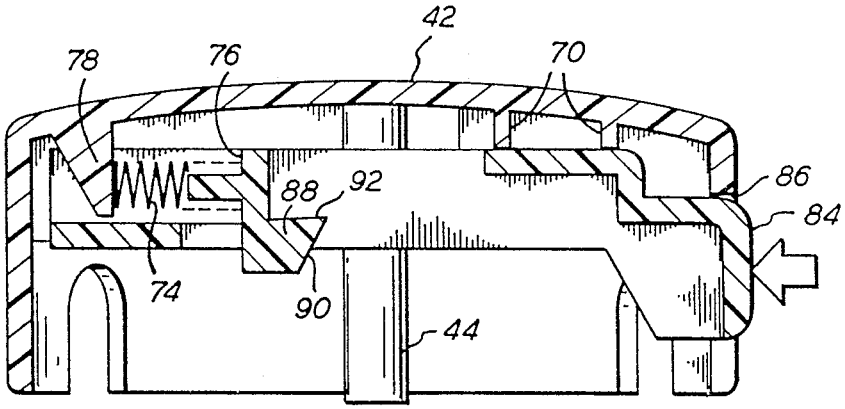
FIG. 7 is an enlarged section view of the cap member and latch bar taken along line 7—7 of FIG. 6.

With reference to FIGS. 2, 3, 4, 6, and 7, the latch means for releasably latching the tensioning means in its tensioned position and the tent body 12 in its erect position, will be described. The latch means comprises a fixed latch member 60 integral with and extending upwardly from the base member 20. The latch member 60 has a latch 62 lug at its end having an inclined cam surface 64 and a latch shoulder 66. The latch means further comprises a latch bar 68 mounted for slidable reciprocal movement between ribs 70 on the inner surface of the top of the cap member 42, the plate 48, and a pair of spaced walls 72 extending from the inner surface of cap member 42 to the plate (FIG. 5). The latch bar 68 is biased by a spring 74 interposed between a flange 76 on the bar and a wall 78 on the cap member 42, causing laterally extending fins 80 on the bar 68 to engage the inner surface of a depending rim 82 on the cap member. This causes a button 84 at the end of the latch bar 68 to extend through an opening 86 in the rim 82 into an exposed position where it can be manually pressed inwardly. The latch bar 68 further has a depending latch ear 88 integral therewith provided with an inclined cam surface 90 and a latch shoulder 92. Accordingly, with reference to FIG. 2, when the cap member 42 is pressed downwardly, in the direction of the arrow, such movement will cause the plate 48 to bear against the tent pole adapters 24 for bending and tensioning the tent poles 16. As the tent pole forces increase, continued downward movement of the cap member against the increasing tent pole force will cause the inclined surface 90 of the bar latch ear 88 to slide along the inclined surface 64 of the latch lug 62. Such movement will continue until the inclined surfaces 64, 90 are no longer in engagement, at which time the latch ear shoulder 92 is forced by the spring 74 in front of the latch lug shoulder 66 for latching the tensioning means in its tensioned position, (see FIG. 3) and the tent body 12 in its erect position. To release the tent, the button 84 is manually pressed inwardly, withdrawing the latch ear 88 from the latch lug 62, whereupon the tension of the poles 16 force the cap member 42 into its normal position, as seen in FIG. 2. This also causes the tent 10 to collapse.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A tent movable between a collapsed position and a latched erect condition, comprising:

a flexible tent body;

tent poles for supporting the tent body;

holding means for releasably attaching one end of the tent poles to the tent body;

apex junction means for supporting the opposite ends of the tent poles, the apex junction means including;

a base member;

a plurality of adapters mounted on one of the ends of the tent poles;

a cap member movably mounted on the base member and adapted when pressed downwardly to engage the adapters and to bend and tension the tent poles for placing the tent body in an erect position; and latch means movable between a normal unlatched position to a latched position for latching the tent poles in a tensioned position and the tent body in its erect position.

2. A tent according to claim 1 wherein the apex junction means comprises a base member having a plurality of slots and the plurality of adapters is pivotally received in said slots.

3. A tent according to claim 2 wherein the tent body has a bottom panel, and wherein the holding means comprises a grommet in the bottom panel for receiving the one end of the tent poles.

4. A tent according to claim 2 wherein the cap member is slidably mounted on the base member.

5. A tent according to claim 4 wherein the latch means comprises a fixed latch lug on the base member, engageable by a latch ear on a slidable spring biased latch ear on the cap member.

6. A tent according to claim 5 wherein the cap member is cup-shaped and has a plate secured thereto, wherein the latch bar is slidably mounted between the cap member and plate with the latch ear extending through the plate, and wherein the latch ear and latch lug have slidably engageable cam surfaces terminating in a latch ear shoulder, and a latch lug shoulder, which cam surfaces are adapted when the cap member is pressed, to retract the latch bar until the cam surfaces are moved out of engagement, causing the spring biased latch ear shoulder to move in front of the latch lug shoulder for placing the latch means in its latched position.

7. A tent according to claim 6, wherein latch ear depends from the latch bar, and wherein an end of the latch bar extends outwardly from the cap member forming a button adapted when pressed to retract the latch ear from the latch lug, to release the latch means for movement by the tensioned poles to its normal unlatched position.

* * * * *